US006318618B1

(12) United States Patent
Jen

(10) Patent No.: US 6,318,618 B1
(45) Date of Patent: Nov. 20, 2001

(54) BARREL UNIT WITH A REMOVABLE COVER PLATE FOR A PNEUMATIC NAIL DRIVING DEVICE

(75) Inventor: Huang Chien Jen, Taichung (TW)

(73) Assignee: Apach Industrial Co., Ltd., Ta-Li (TW)

( * ) Notice: Subject to any disclaimer, the term of this patent is extended or adjusted under 35 U.S.C. 154(b) by 0 days.

(21) Appl. No.: 09/824,368

(22) Filed: Apr. 2, 2001

(30) Foreign Application Priority Data

Dec. 26, 2000 (TW) ..... 89222484 U

(51) Int. Cl.[7] ..... B25C 1/04
(52) U.S. Cl. ..... 227/123; 227/127
(58) Field of Search ..... 227/123, 127, 227/120, 128

(56) References Cited

U.S. PATENT DOCUMENTS 4,436,236 * 3/1984 Jobe ..... 227/123
4,467,952 * 8/1984 Morrell, Jr. ..... 227/123
4,549,681 * 10/1985 Yamamoto et al. ..... 227/123
4,641,772 * 2/1987 Skuthan ..... 227/123
4,688,710 * 8/1987 Massari, Jr. et al. ..... 227/123
5,642,849 * 7/1997 Chen ..... 227/127
6,056,182 * 5/2000 Chen ..... 227/128
6,076,722 * 6/2000 Huang ..... 227/127

* cited by examiner

*Primary Examiner*—Scott A. Smith
(74) *Attorney, Agent, or Firm*—Brinks Hofer Gilson & Lione

(57) ABSTRACT

A barrel unit of a pneumatic nail driving device includes a base plate with a pair of hooking lugs. An elongated cover plate is superimposed on and is pivoted to a rear portion of the base plate, and has a pair of pivot ears, a pair of abutment tabs projecting sidewise respectively from the pivot ears, and a pair of shoulder disposed behind the hooking lugs of the base plate. An operating lever has a pair of pivot ears mounted pivotally on the pivot ears of the cover plate in such a manner that the pivot ears of the operating lever slidably and respectively contact the abutment tabs, and a U-shaped clasper pivotally connected to the operating lever. After disposing the clasper around the hooking lugs, rearward pivotal action of the operating lever results in engagement between the clasper and the hooking lugs and subsequently causes tight engagement between the pivot ears of the operating lever and the abutment tabs, and tight engagement between the shoulders and the hooking lugs.

1 Claim, 6 Drawing Sheets

BARREL UNIT WITH A REMOVABLE COVER PLATE FOR A PNEUMATIC NAIL DRIVING DEVICE

BACKGROUND OF THE INVENTION

1. Field of the Invention

The invention relates to a pneumatic nail driving device, more particularly to a barrel unit with a removable cover plate for a pneumatic nail driving device.

2. Description of the Related Art

In a known pneumatic nail driving device, a nail feeding unit aligns a nail from a nail cartridge with a nail impelling unit so as to discharge the nail via a barrel unit. Jamming of the pneumatic nail driving device usually occurs, thereby preventing the discharge of the nail through the barrel unit. In order to resume proper operation of the pneumatic nail driving device, a cover plate of the barrel unit is removed to remedy the cause of jamming. Thus, it is important for the barrel unit to have a structure which facilitates installation and removal of the cover plate.

Referring to FIGS. 1 and 2, a conventional barrel unit is shown to be installed on a front end of a pneumatic nail driving device 1 and includes an elongated base plate 2 which extends forwardly from the housing of the pneumatic nail driving device 1. The base plate 2 has a top face formed with a longitudinal discharge groove and a pair of upwardly extending hooking lugs 201 which are disposed respectively on opposite sides of the discharge groove and which are located at a front portion of the base plate 2, and a pair of upwardly extending first pivot ears 202 which are disposed respectively on opposite sides of the discharge groove and which are located at a rear portion of the base plate 2. An elongated cover plate 3 is superimposed on the base plate 2, and has a pivot end 300 pivoted to the first pivot ears 202 of the baseplate 2, and a pair of upwardly extending second pivot ears 301 between the pivot end 300 and the hooking lugs 201. A latch includes an operating lever 311 formed with a pair of third pivot ears 311" mounted pivotally on the second pivot ears 301 of the cover plate 30, and a U-shaped clasper 312 secured to the operating lever 311.

After the clasper 312 has been disposed around the hooking lugs 201, the operating lever 311 is turned rearwardly so as to pull the clasper 312 to engage tightly the hooking lugs 201 and so as to press the cover plate 3 against the base plate 2. When it is desired to remove the cover plate 3, the operating lever 311 is turned forwardly to permit removal of the clasper 312 from the hooking lugs 201 and to permit lifting of the cover plate 3 from the base plate 2.

If the pneumatic nail driving device 1 is used to drive several nails in rapid succession, the shock experienced by the cover plate 3 during the nail driving operation may loosen the operating lever 311 in the arrow directions (X,Y), as best shown in FIG. 2, thereby resulting in untimely removal of the cover plate 3 from the base plate 2.

SUMMARY OF THE INVENTION

Therefore, the object of this invention is to provide a barrel unit for a pneumatic nail driving device which can overcome the aforementioned drawback that is generally associated with the conventional pneumatic nail driving device.

Accordingly, a barrel unit of the present invention is adapted to be installed on a front end of a pneumatic nail driving device, and includes an elongated base plate, an elongated cover plate, and a latch unit. The base plate has a top face formed with a longitudinal nail discharge groove, a pair of upwardly extending hooking lugs which are disposed respectively on the opposite sides of the discharge groove and which are located at a front portion of the base plate, and a pair of upwardly extending first pivot ears which are disposed respectively on opposite sides of the discharge groove and which are located at a rear portion of the base plate. The cover plate is superimposed on the top face of the base plate to cover the discharge groove, and has a pivot end pivoted to the first pivot ears of the base plate, a pair of upwardly extending second pivot ears between the pivot end and the hooking lugs, a pair of abutment tabs which project sidewise and respectively from the second pivot ears, and a pair of shoulders which are disposed behind the hooking lugs. The latch unit includes an operating lever formed with a pair of third pivot ears mounted pivotally on the second pivot ears of the cover plate in such a manner that the third pivot ears of the operating lever slidably and respectively contact the abutment tabs, and a U-shaped clasper connected pivotally to the operating lever, and detachably engaging the hooking lugs.

After the clasper has been disposed the clasper around the hooking lugs, the operating lever is turned rearwardly about the second pivot ears so as to result in tight engagement between the clasper and the hooking lugs and subsequently causes tight engagement between the third pivot ears of the operating lever and the abutment tabs, and tight engagement between the shoulders and the hooking lugs, thereby tightening the cover plate on the base plate. Under such a condition, the cover plate is prevented from loosening from the base plate even under the presence of vibrating shocks experienced by the cover plate during the nail driving operation.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
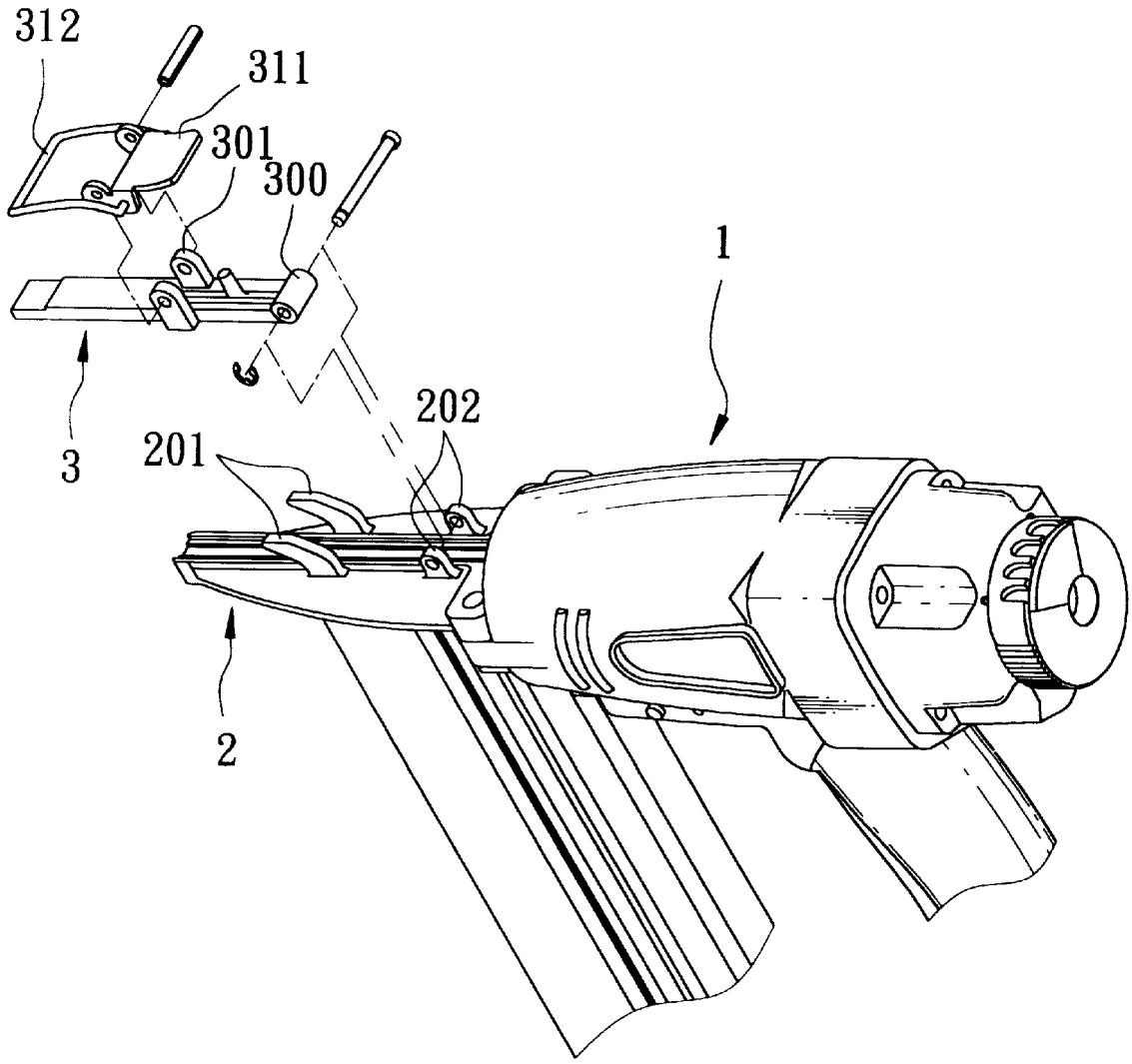
FIG. 1 PRIOR ART
FIG. 1 is a perspective view of a conventional pneumatic nail driving device, wherein a barrel unit employed therein is partly exploded to illustrate an interior thereof.
Figure 2:
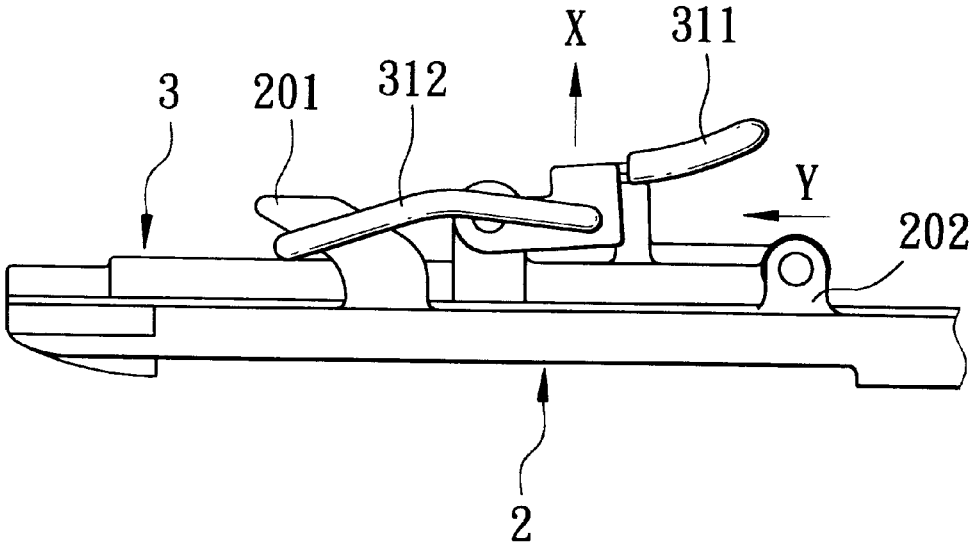
FIG. 2 PRIOR ART
FIG. 2 is a fragmentary side view of the conventional pneumatic nail driving device, illustrating how a cover plate reacts relative to a base plate of the barrel unit upon experiencing of a shock during a nail driving operation.
Figure 3:
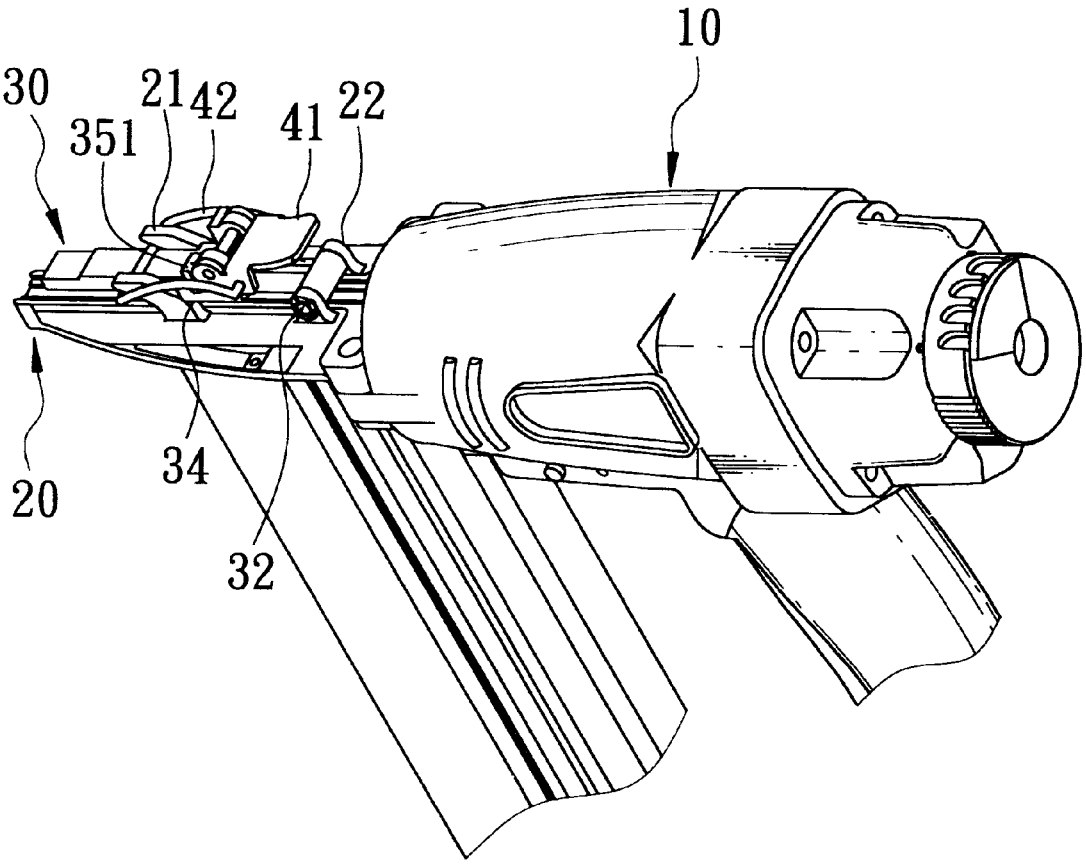
FIG. 3 is a perspective view of a preferred embodiment of a pneumatic nail driving device of the present invention.
Figure 4:
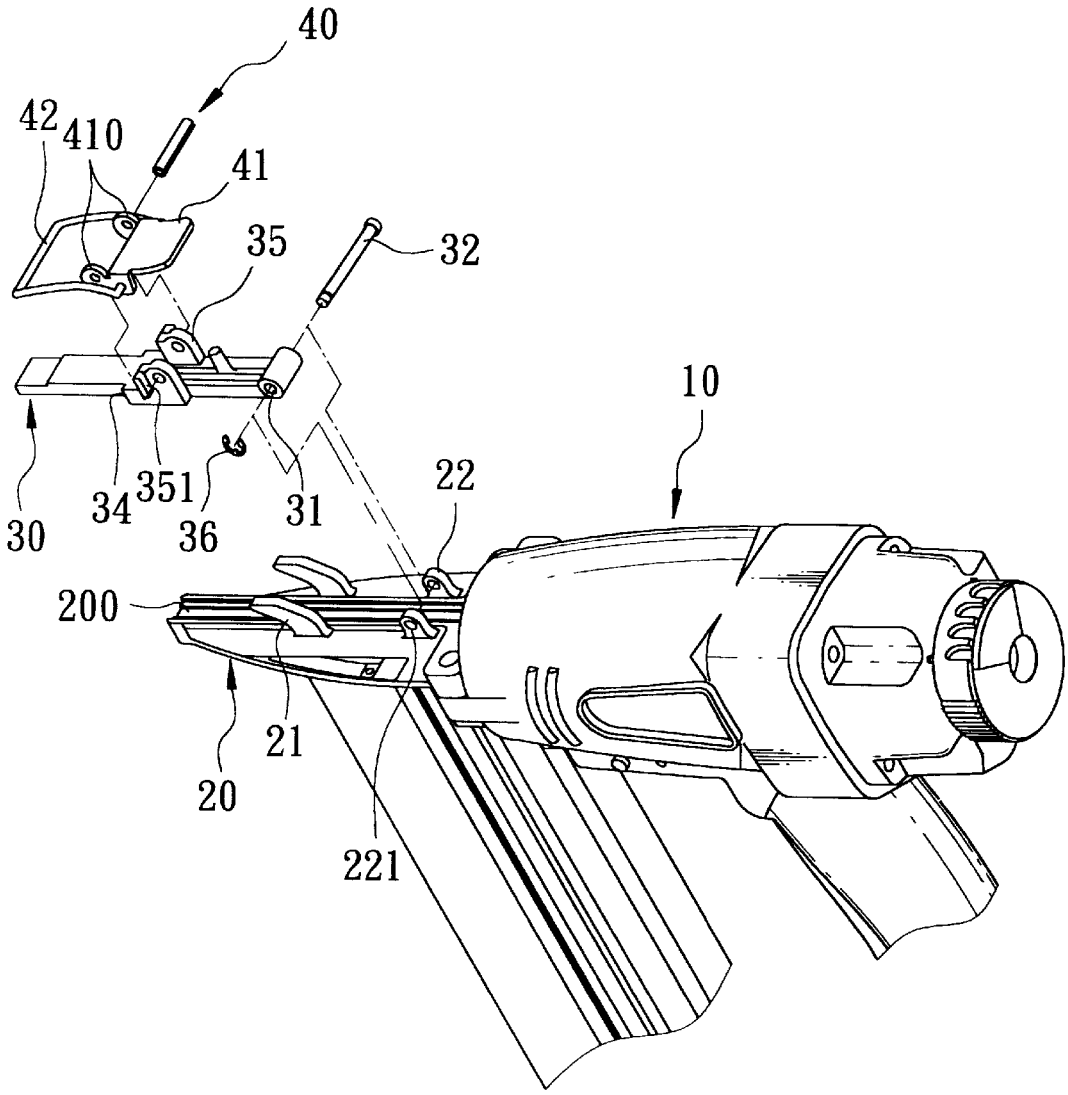
FIG. 4 is a perspective view of the preferred embodiment, wherein a barrel unit employed therein is partly exploded to illustrate an interior thereof.
Figure 5:
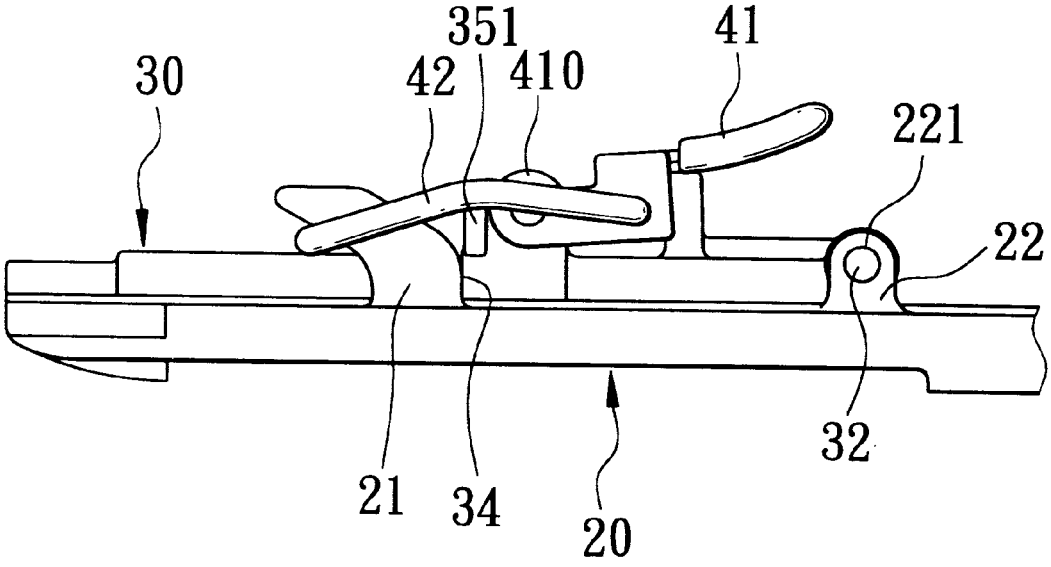
FIG. 5 is a fragmentary side view of the preferred embodiment.

Referring to FIGS. 3, 4 and 5, the preferred embodiment of a barrel unit of the present invention is shown to be installed on a front end of a pneumatic nail driving device 10, and includes an elongated base plate 20, an elongated cover plate 30, and a latch unit 40.

As illustrated, the base plate 20 has a top face formed with a longitudinal nail discharge groove 200, a pair of upwardly extending hooking lugs 21 which are disposed respectively on opposite sides of the discharge groove 200 and which are located at a front portion of the base plate 20, and a pair of upwardly extending first pivot ears 22 which are disposed respectively on the opposite sides of the discharge groove 200 and which are located at a rear portion of the base plate 20.

The cover plate 30 is superimposed on the top face of the base plate 20 to cover the discharge groove 200, and has a pivot end 31 pivoted to the first pivot ears 22 of the base plate 20 by means of a pin 32 and a retainer clip 36, a pair of upwardly extending second pivot ears 35 between the pivot end 31 and the hooking lugs 21, a pair of abutment tabs 351 which project sidewise and respectively from the second pivot ears 35, and a pair of shoulders 34 which are disposed behind the hooking lugs 21.

The latch unit 40 including a U-shaped clasper 42 and an operating lever 41. The operating lever 41 has a pair of third pivot ears 410 mounted pivotally on the second pivot ears 35 of the cover plate 30 in such a manner that the third pivot ears 410 of the operating lever 41 slidably and respectively contact the abutment tabs 351. The clasper 42 has two ends connected pivotally to the operating lever 41 and detachably engaging the hooking lugs 21.

Figure 6:
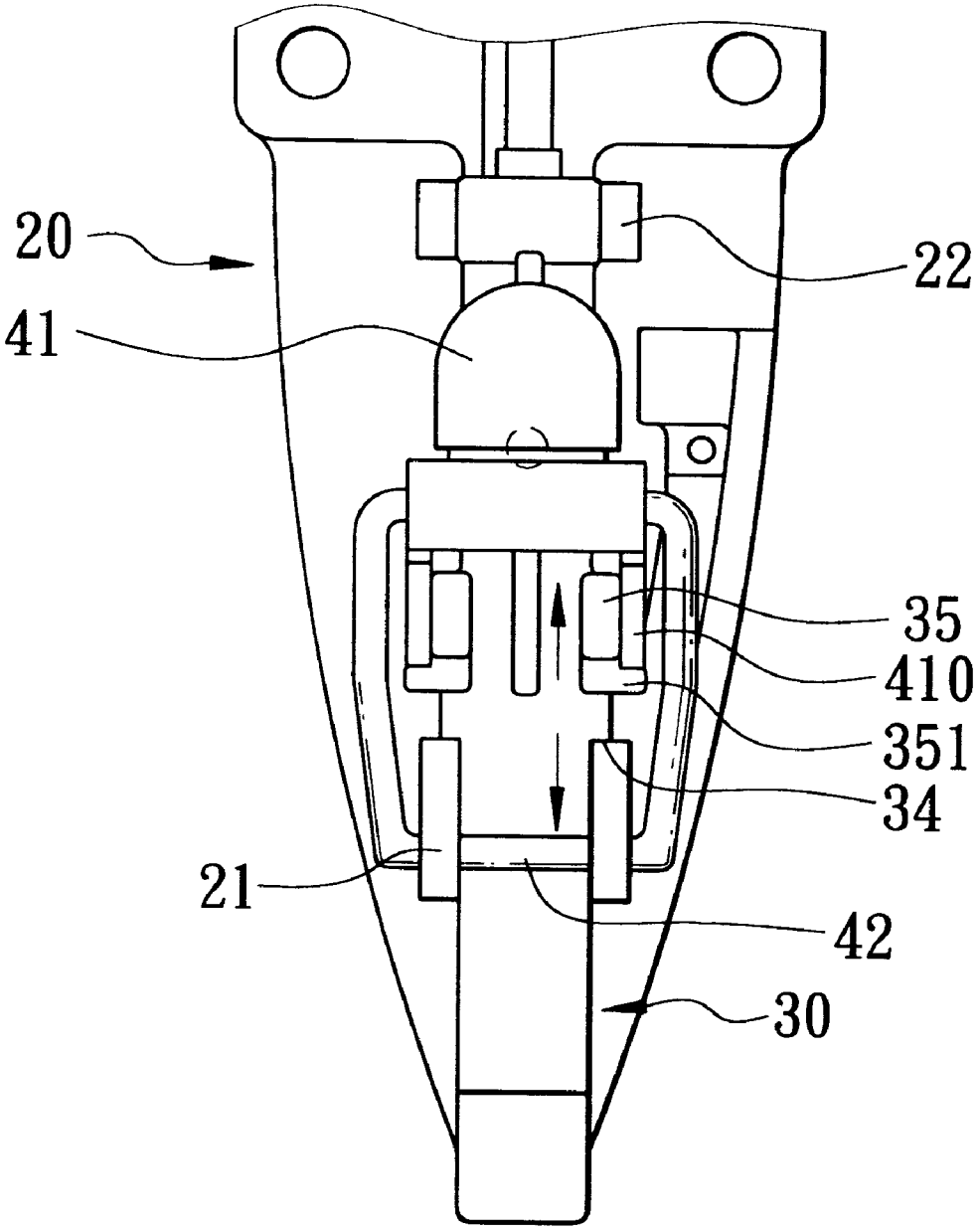
FIG. 6 is a fragmentary top view of the preferred embodiment, the arrow directions respectively indicate forces applied on a cover plate so as to immobilize the same on a base plate of the preferred embodiment.

After the clasper 42 has been disposed the clasper 42 around the hooking lugs 21, the operating lever 41 is pivoted rearwardly about the second pivot ears 35 so as to result in tight engagement between the clasper 42 and the hooking lugs 21 and subsequently causes tight engagement between the third pivot ears 410 of the operating lever 41 and the abutment tabs 351, and tight engagement between the shoulders 34 and the hooking lugs 21, thereby tightening the cover plate 30 on the base plate 20. Under such a condition, the cover plate 30 is prevented from loosening from the base plate 20 even under the presence of vibrating shocks experienced by the cover plate 30 during the nail driving operation by virtue of the engagement between the clasper 42 and the hooking lugs 21, between the abutment tabs 351 and the operating lever 41, and between the shoulders 34 and the hooking lugs 21, as shown by arrows in FIG. 6.

With this invention thus explained, it is apparent that numerous modifications and variations can be made without departing from the scope and spirit of this invention. It is therefore intended that this invention be limited only as indicated in the appended claims.

I claim:

1. A barrel unit adapted to be installed on a front end of a pneumatic nail driving device, said barrel unit comprising:

an elongated base plate having a top face formed with a longitudinal nail discharge groove, a pair of upwardly extending hooking lugs which are disposed respectively on opposite sides of said discharge groove and which are located at a front portion of said base plate, and a pair of upwardly extending first pivot ears which are disposed respectively on said opposite sides of said discharge groove and which are located at a rear portion of said base plate;

an elongated cover plate superimposed on said top face of said base plate to cover said discharge groove, and having a pivot end pivoted to said first pivot ears of said base plate, a pair of upwardly extending second pivot ears between said pivot end and said hooking lugs, a pair of abutment tabs projecting sidewise and respectively from said second pivot ears, and a pair of shoulders disposed behind said hooking lugs; and a latch unit including an operating lever formed with a pair of third pivot ears mounted pivotally on said second pivot ears of said cover plate in such a manner that said third pivot ears of said operating lever slidably and respectively contact said abutment tabs, and a U-shaped clasper connected pivotally to said operating lever and detachably engaging said hooking lugs;

whereby, after disposing said clasper around said hooking lugs, rearward pivotal action of said operating lever about said second pivot ears results in tight engagement between said clasper and said hooking lugs and subsequently causes tight engagement between said third pivot ears of said operating lever and said abutment tabs, and tight engagement between said shoulders and said hooking lugs, thereby tightening said cover plate on said base plate.

* * * * *